US008931775B2

(12) United States Patent
Murashima et al.

(10) Patent No.: US 8,931,775 B2
(45) Date of Patent: Jan. 13, 2015

(54) SHEET CONVEYING DEVICE AND IMAGE FORMING APPARATUS INCLUDING THE SHEET CONVEYING DEVICE

(71) Applicant: KYOCERA Document Solutions Inc., Osaka (JP)

(72) Inventors: Masaki Murashima, Osaka (JP); Yasuyuki Fukunaga, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/011,589

(22) Filed: Aug. 27, 2013

(65) Prior Publication Data

US 2014/0062006 A1 Mar. 6, 2014

(30) Foreign Application Priority Data

Aug. 29, 2012 (JP) ..... 2012-188845

(51) Int. Cl.

| | |
|---|---|
| ***B65H 3/44*** | (2006.01) |
| ***B65H 5/00*** | (2006.01) |
| ***B65H 5/26*** | (2006.01) |
| ***B65H 5/06*** | (2006.01) |

(52) U.S. Cl.

CPC ..... *B65H 5/062* (2013.01)
USPC ..... 271/9.11; 271/9.13; 271/10.11; 271/264

(58) Field of Classification Search

USPC ..... 271/10.09, 10.11, 9.11, 9.13, 264
See application file for complete search history.

(56) References Cited

U.S. PATENT DOCUMENTS

| | | | | |
|---|---|---|---|---|
| 6,293,541 | B1 * | 9/2001 | Horiuchi et al. | 271/184 |
| 8,590,885 | B2 * | 11/2013 | Seki | 271/10.09 |
| 2009/0324311 | A1 * | 12/2009 | Matsumoto | 399/400 |

FOREIGN PATENT DOCUMENTS

JP 10-035980 A 2/1998

* cited by examiner

*Primary Examiner* — David H Bollinger
(74) *Attorney, Agent, or Firm* — Studebaker & Brackett PC

(57) ABSTRACT

A sheet conveying device includes a sheet conveying path, a first conveying roller pair, a second conveying roller pair and a sheet guiding member. The sheet conveying path conveys a sheet in a first direction, and then, conveys the sheet in a second direction. The first conveying roller pair conveys the sheet in the first direction. The second conveying roller pair is located at a downstream side from the first conveying roller pair to convey the sheet to the second direction from the first direction. The sheet guiding member is located between the first conveying roller pair and second conveying roller pair so as to advance and retreat to the sheet conveying path, and then, in an advance state, to come into contact with a sheet face of the sheet conveyed while being bridged across the first conveying roller pair and second conveying roller pair.

20 Claims, 11 Drawing Sheets

SHEET CONVEYING DEVICE AND IMAGE FORMING APPARATUS INCLUDING THE SHEET CONVEYING DEVICE

INCORPORATION BY REFERENCE

This application is based on and claims the benefit of priority from Japanese Patent application No. 2012-188845 filed on Aug. 29, 2012, the entire contents of which are incorporated herein by reference.

BACKGROUND

The present disclosure relates to a sheet conveying device conveying a sheet and an image forming apparatus including this sheet conveying device.

In an image forming apparatus forming an image on a sheet, a toner image is formed on a photosensitive drum by an image forming part and the toner image is transferred to the sheet by a transfer nip part arranged between the photosensitive drum and a transfer roller. The image forming apparatus also includes a fixing part. The sheet having the transferred toner image is subjected to a fixing process by the fixing part, and then, ejected.

In the above-mentioned image forming apparatus, because the sheets in different sizes are used, a plurality of stages of sheet cartridges are arranged as a sheet conveying device below the image forming apparatus. The sheet discharged from each sheet cartridge is fed to a sheet conveying path extending in upward and downward directions at one end side of the plurality of stages of the sheet cartridges, and then, conveyed to the image forming part in which the toner image is formed on the sheet.

The above-mentioned sheet conveying path is extended so as to curve in order to vary a direction conveying the sheet. In order to guide the sheet along the curved sheet conveying path, a conveyance guide is provided in the sheet conveying path. Generally, in order to lower friction resistance of the sheet, a rib is attached to the conveyance guide. Particularly, in a case where a firm thick paper is conveyed, in order to lower conveyance noise being caused when the sheet comes into contact with a face of the conveyance guide, the above-mentioned rib is often required. In addition, a technique providing the sheet conveying path with a separating claw so that the separating claw guides the sheet to an inversion path is disclosed.

In the above-mentioned technique, in a case where a thin paper, such as a recycled paper, is guided by the rib provided in the sheet conveying path, waviness of the sheet is often caused. Even in a configuration without providing the above-mentioned rib, in a case where the thin sheet is conveyed while being bridged across conveying rollers located at a distance in the sheet conveying direction, similar waviness is often caused by tensile strength applied to the sheet.

SUMMARY

In accordance with an embodiment of the present disclosure, a sheet conveying device includes a housing, a sheet conveying path, a first conveying roller pair, a second conveying roller pair and a sheet guiding member. The sheet conveying path is arranged in the housing to convey a sheet in a first direction, and then, to convey the sheet in a second direction crossing the first direction. The first conveying roller pair conveys the sheet in the first direction. The second conveying roller pair is located at a downstream side in a sheet conveying direction from the first conveying roller pair to convey the sheet to the second direction from the first direction. The sheet guiding member is located between the first conveying roller pair and second conveying roller pair so as to advance and retreat to the sheet conveying path, and then, in an advance state, to come into contact with a sheet face of the sheet conveyed while being bridged across the first conveying roller pair and second conveying roller pair.

In accordance with an embodiment of the present disclosure, an image forming apparatus includes a sheet conveying device and an image forming part. The sheet conveying device includes a housing, a sheet conveying path, a first conveying roller pair, a second conveying roller pair and a sheet guiding member. The sheet conveying path is arranged in the housing to convey a sheet in a first direction, and then, to convey the sheet in a second direction crossing the first direction. The first conveying roller pair conveys the sheet in the first direction. The second conveying roller pair is located at a downstream side in a sheet conveying direction from the first conveying roller pair to convey the sheet to the second direction from the first direction. The sheet guiding member is located between the first conveying roller pair and second conveying roller pair so as to advance and retreat to the sheet conveying path, and then, in an advance state, to come into contact with a sheet face of the sheet conveyed while being bridged across the first conveying roller pair and second conveying roller pair. The image forming part forms an image on the sheet conveyed in the second direction.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
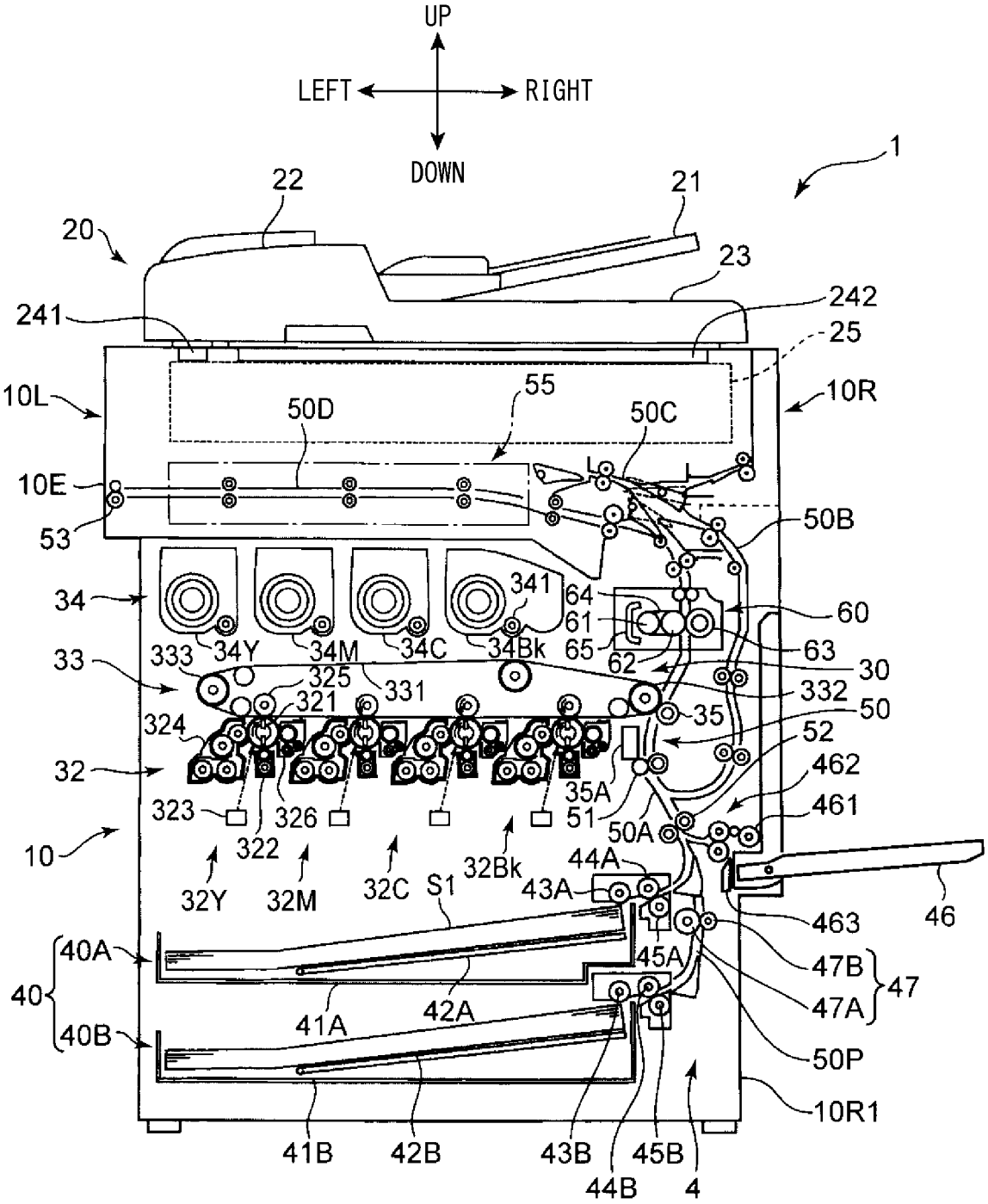
FIG. 1 is a sectional view schematically showing an internal configuration of an image forming apparatus according to an embodiment of the present disclosure.
Figure 2:
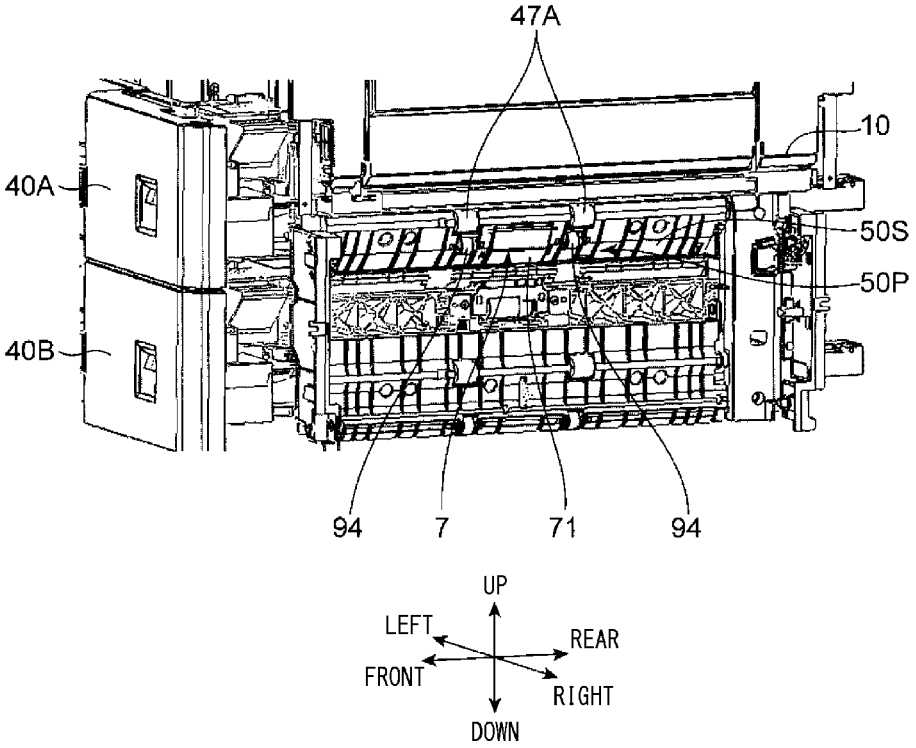
FIG. 2 is a perspective view schematically showing a sheet conveying path arranged at a side part of the image forming apparatus according to an embodiment of the present disclosure.

In the following, an embodiment of the present disclosure will be described in detail with reference to the drawings. FIG. 1 is a sectional view schematically showing an internal configuration of an image forming apparatus 1 according to the embodiment of the present disclosure. FIG. 2 is a perspective view schematically showing a lower part of the image forming apparatus 1. Here, as the image forming apparatus 1, although a multifunction machine having a printer function and a copy function is illustrated, the image forming apparatus may be a printer, a copying machine or a facsimile.

First, the image forming apparatus will be described. The image forming apparatus 1 includes an apparatus main body (a housing) 10 having a roughly rectangular-parallelepiped formed housing structure and an automatic document feeding device 20 located above the apparatus main body 10. Inside the apparatus main body 10, a reading unit 25, an image forming part 30, a fixing part 60, a sheet feeding device (a sheet conveying device) 4, a conveying path 50 and a conveying unit 55 are installed. The reading unit 25 optically reads a document image to be copied. The image forming part 30 forms a toner image on a sheet. The fixing part 60 fixes the toner image on the sheet. The sheet feeding device 4 feeds a regular sheet to the image forming part 30. In the conveying path 50, the regular sheet is conveyed from the sheet feeding device 4 or a fed sheet tray 46 via the image forming part 30 and fixing part 60 to a sheet ejecting port 10E. Inside the conveying unit 55, a sheet conveying path as apart of the conveying path 50 is arranged.

The automatic document feeding device (ADF) 20 is turnably attached to a top face of the apparatus main body 10. The ADF 20 automatically feeds a document sheet to be copied to a predetermined document reading position (a position at which a first contact glass 241 is fitted) in the apparatus main body 10. On the other hand, when a user manually places the document sheet on another predetermined document reading position (another position at which a second contact glass 242 is fitted), the ADF 20 is opened upward. The ADF 20 includes a document tray 21 on which the document sheet is placed, a document conveying part 22 conveying the document sheet via a document automatic-reading position and an ejected document tray 23 on which the document sheet after reading is ejected.

The reading unit 25 optically reads an image of the document sheet via the first contact glass 241 for reading the document sheet automatically fed from the ADF on the top face of the apparatus main body 10, or via the second contact glass 242 for reading the document sheet manually placed. In the reading unit 25, a light source, a movement carriage, a scanning mechanism having a reflective mirror and others, and an imaging device are installed (not shown). The scanning mechanism irradiates the document sheet with a light and leads a reflected light by the document sheet to the imaging device. The imaging device photoelectrically converts the reflected light to an analog electrical signal. The analog electrical signal is converted to a digital electrical signal by an analog/digital (A/D) converting circuit, and then, inputted to the image forming part 30.

The image forming part 30 carries out processes forming a full color toner image and transferring this toner image to the sheet. The image forming part 30 includes an image forming unit 32, an intermediate transferring unit 33 located adjacent to and above the image forming unit 32, and a toner supplying part 34 located above the intermediate transferring unit 33. The image forming unit 32 includes four units 32Y, 32M, 32C and 32Bk arranged in tandem that respectively form a yellow (Y) toner image, a magenta (M) toner image, a cyan (C) toner image and a black (Bk) toner image.

Each of the image forming unit 32Y, 32M, 32C and 32Bk includes a photosensitive drum 321, and a charger 322, an exposure device 323, a development device 324, a first transfer roller 325 and a cleaning device 326 located around the photosensitive drum 321.

The photosensitive drum 321 rotates around its axis so that an electrostatic latent image and the toner image are formed on the circumference face of the photosensitive drum 321. As the photosensitive drum 321, a photosensitive drum made of an amorphous silicon-series (a-Si) material may be applied. The charger 322 uniformly electric-charges a surface of the photosensitive drum 321. The exposure device 323 includes a laser light source and optical instruments, such as a mirror and lens. The exposure device 323 irradiates the circumference of the photosensitive drum 321 with a light based on image data of the document image to form the electrostatic latent image.

The development device 324 supplies a toner (a developer) to the circumference of the photosensitive drum 321 in order to develop the electrostatic latent image formed on the photosensitive drum 321. The development device 324 is provided for the developer consisting of two components. The development device 324 includes a screw feeder, a magnetic roller and a developing roller.

The first transfer roller 325 is located at the opposite of the photosensitive drum 321 across an intermediate transferring belt 331 to form a nip part with the photosensitive drum 321 so as to first-transfer the toner image on the photosensitive drum 321 to the intermediate transferring belt 331. The cleaning device 326 includes a cleaning roller and others. The cleaning device 326 cleans the circumference of the photosensitive drum 321 after the toner image is transferred.

The intermediate transferring unit 33 includes the intermediate transferring belt 331, a driving roller 332 and a following roller 333. The intermediate transferring belt 331 is an endless belt wound around the driving roller 332 and following roller 333. To the circumference of the intermediate transferring belt 331, the toner images from a plurality of the photosensitive drums 321 are transferred so as to be superimposed at same one place (a first transfer).

Facing to the circumference of the driving roller 332, a second transfer roller 35 is located. A nip part between the driving roller 332 and second transfer roller 35 is a second transfer part transferring the full color toner image superimposed on the intermediate transferring belt 331 to the sheet. To one roller of the driving roller 332 and second transfer roller 35, second transfer bias potential having a reversed bias to the toner image is applied, but another roller is grounded.

The toner supplying part 34 includes a yellow toner container 34Y, a magenta toner container 34M, a cyan toner container 34C and a black toner container 34Bk. These toner containers 34Y, 34M, 34C and 34Bk contain respective corresponding color toners and respectively supply the corresponding color toners to the development devices 324 of the image forming unit 32Y, 32M, 32C and 32Bk corresponding to the respective colors of Y, M, C and Bk via supplying paths (not shown). Each of the toner containers 34Y, 34M, 34C and 34Bk includes a conveying screw 341 conveying the toner in the container to a toner ejecting port (not shown). The conveying screw 341 is driven and rotated by a driving part (not shown) to supply the toner into the development device 324.

The sheet feeding device 4 includes a sheet feeding part 40. The sheet feeding part 40 includes two stages of a first fed sheet cartridge 40A and a second fed sheet cartridge 40B (sheet loading parts) storing the regular sheet S1 among sheets to be subjected an image forming process. These fed sheet cartridges is configured so as to be pulled out from a front side of the apparatus main body 10 in a forward direction.

The first fed sheet cartridge 40A includes a sheet storing part 41A storing a sheet stack having piled regular sheets S1 and a lift board 42A lifting up the sheet stack in order to feed the sheet. In an upper part of a right end side of the first fed sheet cartridge 40A, a pickup roller 43A, and a roller pair of a sheet feeding roller 44A and a retard roller 45A are located. The pickup roller 43A and sheet feeding roller 44A are driven to pick up the sheet S1 from the top layer of the sheet stack in the first fed sheet cartridge 40A one by one and to convey the picked-up sheet to the conveying path 50.

Similarly, the second fed sheet cartridge 40B includes a sheet storing part 41B storing a sheet stack having piled regular sheets S1 and a lift board 42B lifting up the sheet stack in order to feed the sheet. In an upper part of a right end side of the second fed sheet cartridge 40B, a pickup roller 43B, and a roller pair (a first conveying roller pair) of a sheet feeding roller 44B and a retard roller 45B are located. The pickup roller 43B and sheet feeding roller 44B are driven to pick up the sheet S1 from the top layer of the sheet stack in the second fed sheet cartridge 40B one by one and to convey the picked-up sheet to a fed sheet conveying path 50P (a sheet conveying path) at an upstream side of the conveying path 50. In addition, in the fed sheet conveying path 50P, another conveying roller pair (a second conveying roller pair) 47 is located. The conveying roller pair 47 includes a first conveying roller 47A and a second conveying roller 47B. The conveying roller pair 47 conveys the sheet S1 picked-up from the second fed sheet cartridge 40B via the conveying path 50 to the image forming part 30.

In a right side face 10R of the apparatus main body 10, the fed sheet tray 46 for manual bypass sheet feeding is provided. A lower end part of the fed sheet tray 46 is openably/closably attached to the apparatus main body 10. In a case of carrying out the manual bypass sheet feeding, the user opens the fed sheet tray 46 as shown in the figure and places the sheet thereon. The sheet placed on the fed sheet tray 46 is conveyed to the conveying path 50 by driving a pickup roller 461 and a sheet feeding roller 462.

The conveying path 50 includes a main conveying path 50A, an inversion conveying path 50B, a switchback conveying path 50C and a horizontal conveying path 50D. The main conveying path 50A conveys the sheet (the regular sheet S1) from the fed sheet conveying path 50P of the sheet feeding part 40 via the image forming part 30 to an exit port of the fixing part 60. The inversion conveying path 50B returns back a simplex printed sheet to the image forming part 30 when a duplex printing is performed to the sheet. The switchback conveying path 50C directs the sheet from a downstream end of the main conveying path 50A to an upstream end of the inversion conveying path 50B. The horizontal conveying path 50D conveys the sheet from the downstream end of the main conveying path 50A to the sheet ejecting port 10E provided in a left side face 10L of the apparatus main body 10 in a horizontal direction. The most part of the horizontal conveying path 50D is made by a sheet conveying path provided in the conveying unit 55.

At an upstream side from the second transfer part 35A in the main conveying path 50A, a pair of resist rollers 51 are located. The sheet is temporarily stopped by the pair of resist rollers 51 to carry out skew correction. After that, at a given timing for transferring the image, the pair of resist rollers 51 is driven and rotated by a drive motor (not shown) to convey the sheet to the second transfer part. Besides this, in the main conveying path 50A, a plurality of conveying rollers 52 for conveying the sheet are located.

At a most downstream end of the conveying path 50, a sheet ejecting roller 53 is located. The sheet ejecting roller 53 feeds the sheet via the sheet ejecting port 10E to a post-process device (not shown) attached to the left side face 10L of the apparatus main body 10. On the other hand, in the image forming apparatus without attaching the post-process device, an ejected sheet tray is provided below the sheet ejecting port 10E.

The conveying unit 55 is a unit conveying the sheet conveyed from the fixing part 60 to the sheet ejecting port 10E. In the image forming apparatus 1 of the embodiment, the fixing part 60 is located at a side of the right side face 10R of the apparatus main body 10 and the sheet ejecting port 10E is located at another side of the left side face 10L facing to the right side face 10R in the apparatus main body 10. Therefore, the conveying unit 55 conveys the sheet from the right side face 10R to the left side face 10L in the apparatus main body 10 in the horizontal direction.

The fixing part 60 is a fixing device of an induction heating manner carrying out a fixing process fixing the toner image to the sheet. The fixing part 60 includes a heating roller 61, a fixing roller 62, a pressing roller 63, a fixing belt 64 and an induction heating unit 65. The pressing roller 63 is pressurized to the fixing roller 62 to form a fixing nip part. The heating roller 61 and fixing belt 64 are inductively heated by the induction heating unit 65 to apply the heat to the fixing nip part. When the sheet passes through the fixing nip part, the toner image transferred to the sheet is fixed to the sheet.

Figure 3:
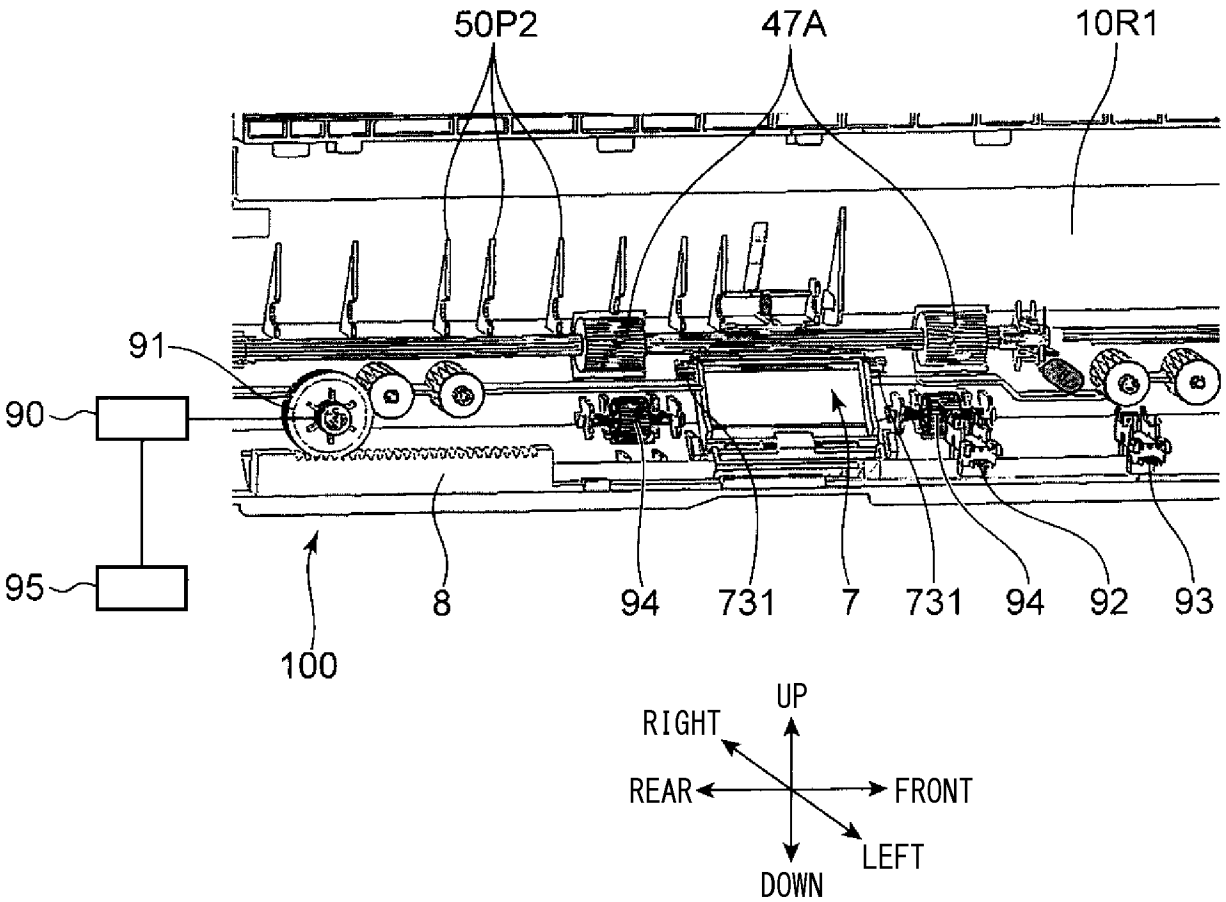
FIG. 3 is an internal perspective view schematically showing the sheet conveying path according to an embodiment of the present disclosure.
Figure 4:
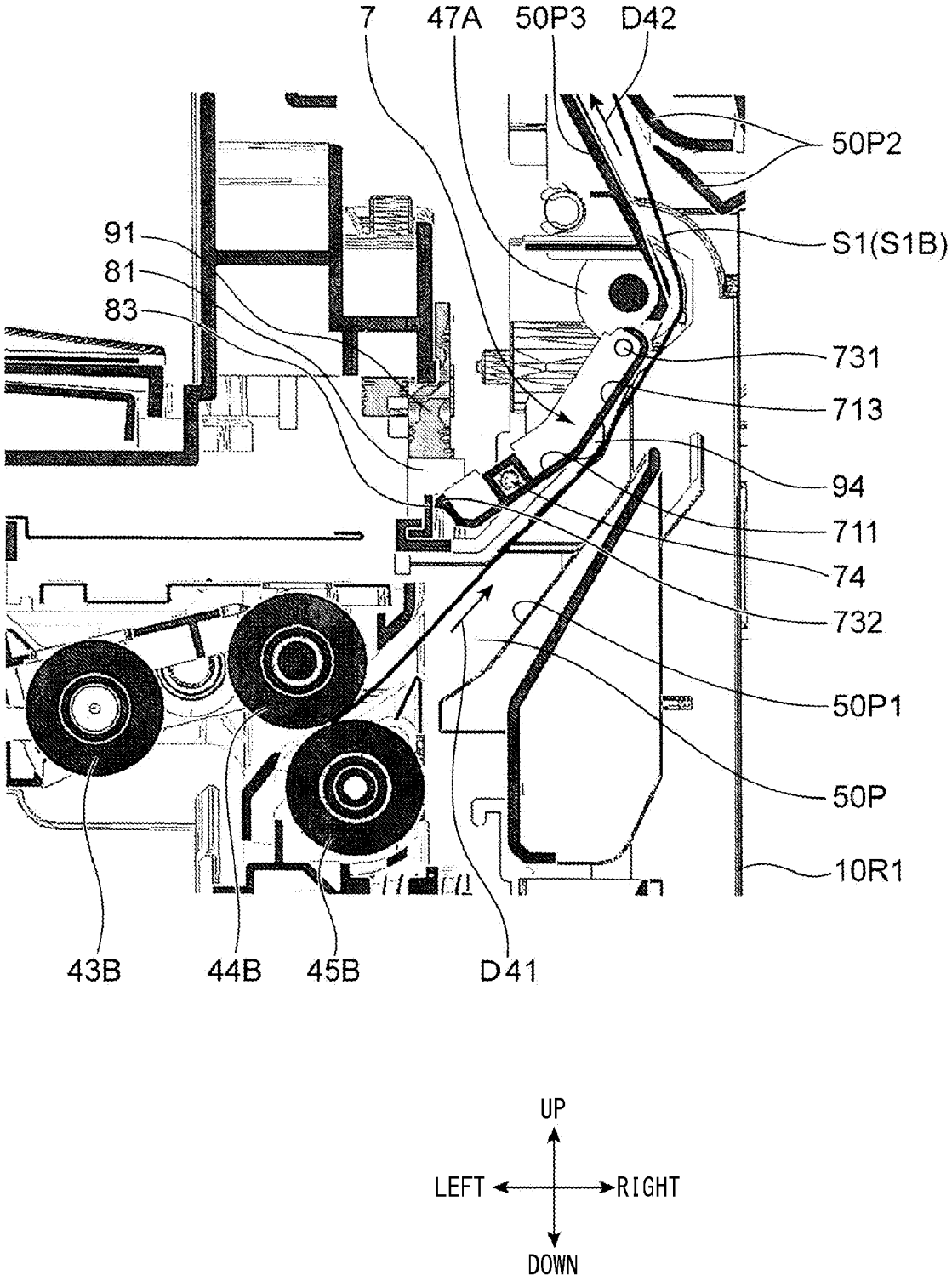
FIG. 4 is a sectional view schematically showing the sheet conveying path in a situation, in which a sheet guiding member retreats, according to an embodiment of the present disclosure.

Next, with reference to FIGS. 3 and 4 in addition to FIGS. 1 and 2, configurations of the fed sheet conveying path 50P and its periphery will be described in detail. FIG. 3 is a perspective view showing the fed sheet conveying path 50P as seen in inside view of the apparatus main body 10. FIG. 4 is a sectional view showing the fed sheet conveying path 50P according to the embodiment. In the embodiment, in the fed sheet conveying path 50P constituting the upstream side of the conveying path 50, the sheet S1 is conveyed in a right and upward direction (a first direction, indicated by an arrow D41 in FIG. 4), and then, conveyed in a left and upward direction (a second direction, indicated by an arrow D42 in FIG. 4). In detail, the sheet S1 loaded in the second fed sheet cartridge 40B is picked up by the pickup roller 43B. Moreover, by the nip part of the sheet feeding roller 44B and retard roller 45B, one sheet S1 loaded at the top layer is conveyed in the above-mentioned first direction. At this time, with regard to the conveying path conveying the sheet S1, a lower side is defined by a first guide part 50P1 and a upper side is defined by a conveyance guide (a guide member) 50S (FIG. 2).

Subsequently, the sheet S1 reached to the conveying roller pair 47 (FIG. 1) is further conveyed upward while being stretched on the circumference face of the first conveying roller 47A with keeping a predetermined width. At this time, the conveying direction of the sheet S1 is varied to the above-mentioned second direction by the second conveying roller 47B. At a downstream side from the conveying roller pair 47, with regard to the fed sheet conveying path 50P, a right side is defined by a second guide part 50P2 (FIGS. 3 and 4) and a left side is defined by a third guide part 50P3 (FIG. 4).

As described above, in a configuration of conveying the sheet S1 from the first direction to the second direction, the sheet S1 is conveyed while being bridged across the roller pair of the sheet feeding roller 44B and retard roller 45B and the conveying roller pair 47. At this time, in a case of conveying a thin paper represented by a basic weight less than 55 g/m$^2$ as the sheet S1A, the sheet S1A is conveyed while being stretched between the sheet feeding roller 44B and first conveying roller 47A. Particularly, after the sheet S1A has been fed, when drive of the sheet feeding roller 44B is stopped and the sheet S1A is conveyed while being stretched by the first conveying roller 47A, tensile strength applied to the sheet S1A is increased. As a result, there is a possibility that a plurality of wavinesses extending in the sheet conveying direction is formed at a distance in a sheet width direction (a direction crossing the sheet conveying direction, e.g. forward and backward directions) on the sheet S1A. Such wavinesses may cause image quality failure when the toner image is formed in the image forming part 30.

In order to solve the above-mentioned problem, in the embodiment, a movable conveyance guide (a sheet guiding member) 7 is located. The movable conveyance guide 7 is located between the sheet feeding roller 44B and first conveying roller 47A so as to advance and retreat to the fed sheet conveying path 50P. When the movable conveyance guide 7 becomes an advance state, the movable conveyance guide 7 comes into contact with a sheet face of the sheet S1 conveyed while being bridged across the roller pair of the sheet feeding roller 44B and retard roller 45B and the conveying roller pair 47. As a result, it is possible to suitably restrain the waviness from being formed on the sheet face of the sheet S1.

In addition, in the embodiment, in a case (e.g. the sheet S1A) where thickness of the sheet S1 conveyed in the fed sheet conveying path 50P is thinner than a predetermined threshold, the movable conveyance guide 7 becomes the advance state to the fed sheet conveying path 50P. Alternatively, in another case where the thickness of the sheet S1 is thicker than the threshold, the movable conveyance guide 7 retreats from the fed sheet conveying path 50P. If the sheet S1 conveyed in the fed sheet conveying path 50P is a firm thick paper (e.g. the sheet S1B), the above-mentioned waviness difficultly occurs. On the other hand, there is a possibility that friction resistance of the sheet S1B to the movable conveyance guide 7 causes conveyance noise. Moreover, if the movable conveyance guide 7 interfered with conveyance of the sheet S1B and slide resistance of the sheet S1B were increased, conveyance failure by the sheet feeding roller 44B or the first conveying roller 47A were easily caused. Therefore, in the embodiment, in accordance with the thickness of the sheet S1, advance movement and retreat movement of the movable conveyance guide 7 are controlled. For example, as mentioned above, in the embodiment, the threshold of the thickness (the basic weight) of the sheet S1 when the movable conveyance guide 7 advances is determined by 55 g/m$^2$.

The sheet feeding device 4 further includes conveyance assisting rollers 94. As referred to FIG. 2, the conveyance assisting rollers 94 are located so as to interpose the movable conveyance guide 7 in the sheet width direction and assists conveyance of the sheet S1 to the first conveying roller 47A. The conveyance assisting rollers 94 are located as a pair at both sides of the movable conveyance guide 7. Particularly, in the embodiment, the conveyance assisting rollers 94 is following rollers rotating by following the sheet S1.

Figure 5:
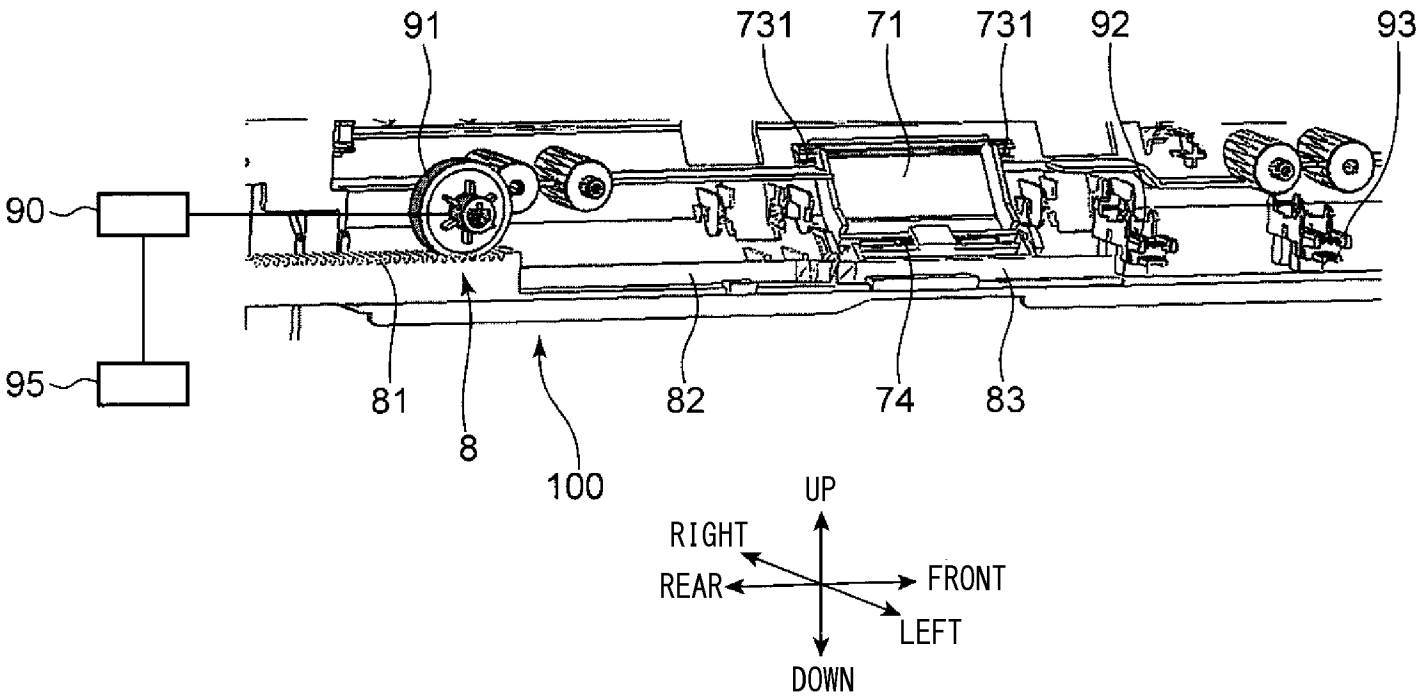
FIG. 5 is a perspective view schematically showing a switching part in the situation shown in FIG. 4.
Figure 6:
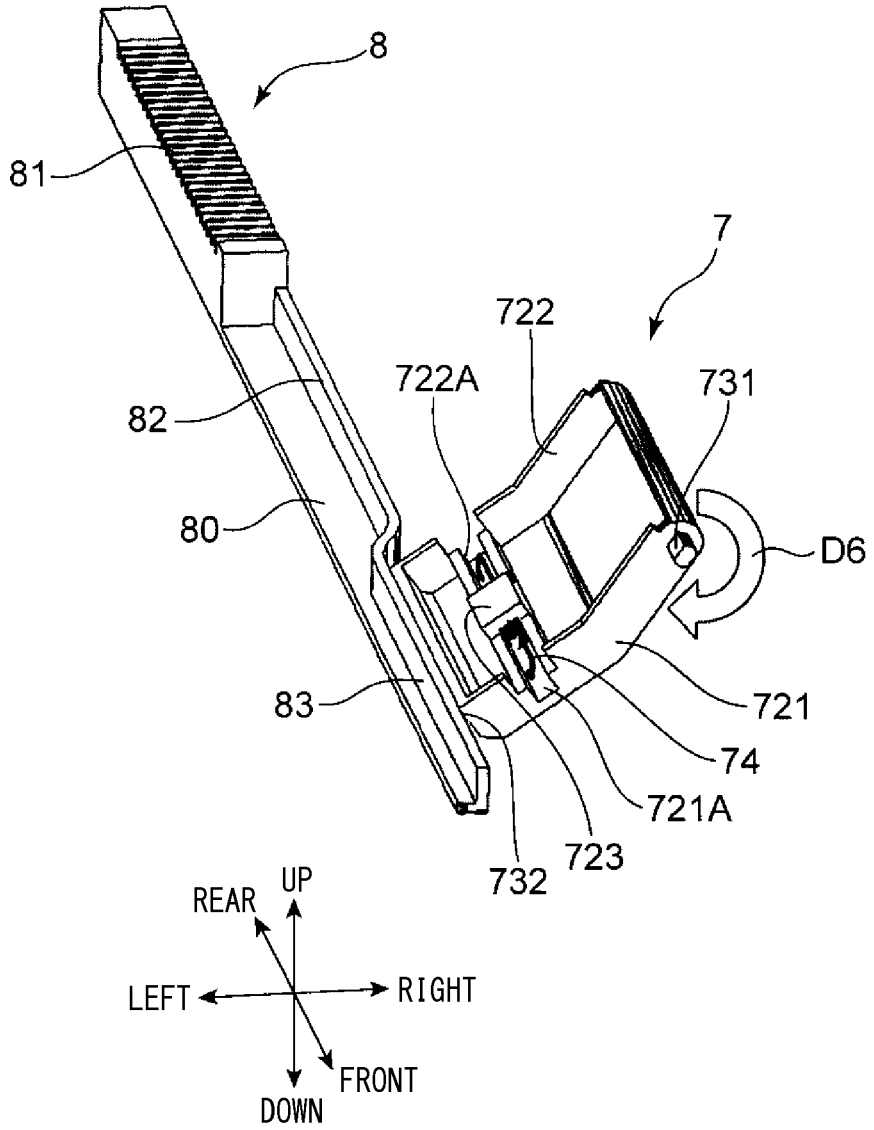
FIG. 6 is a perspective view schematically showing a contact member and the sheet guiding member in the situation shown in FIG. 4.
Figure 7:
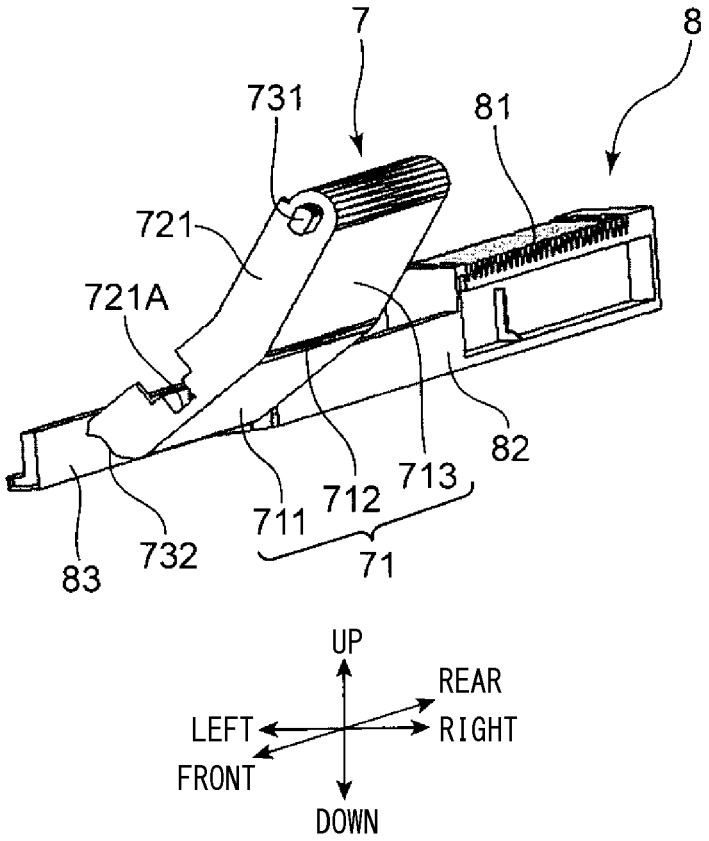
FIG. 7 is another perspective view schematically showing the contact member and sheet guiding member in the situation shown in FIG. 4.
Figure 8:
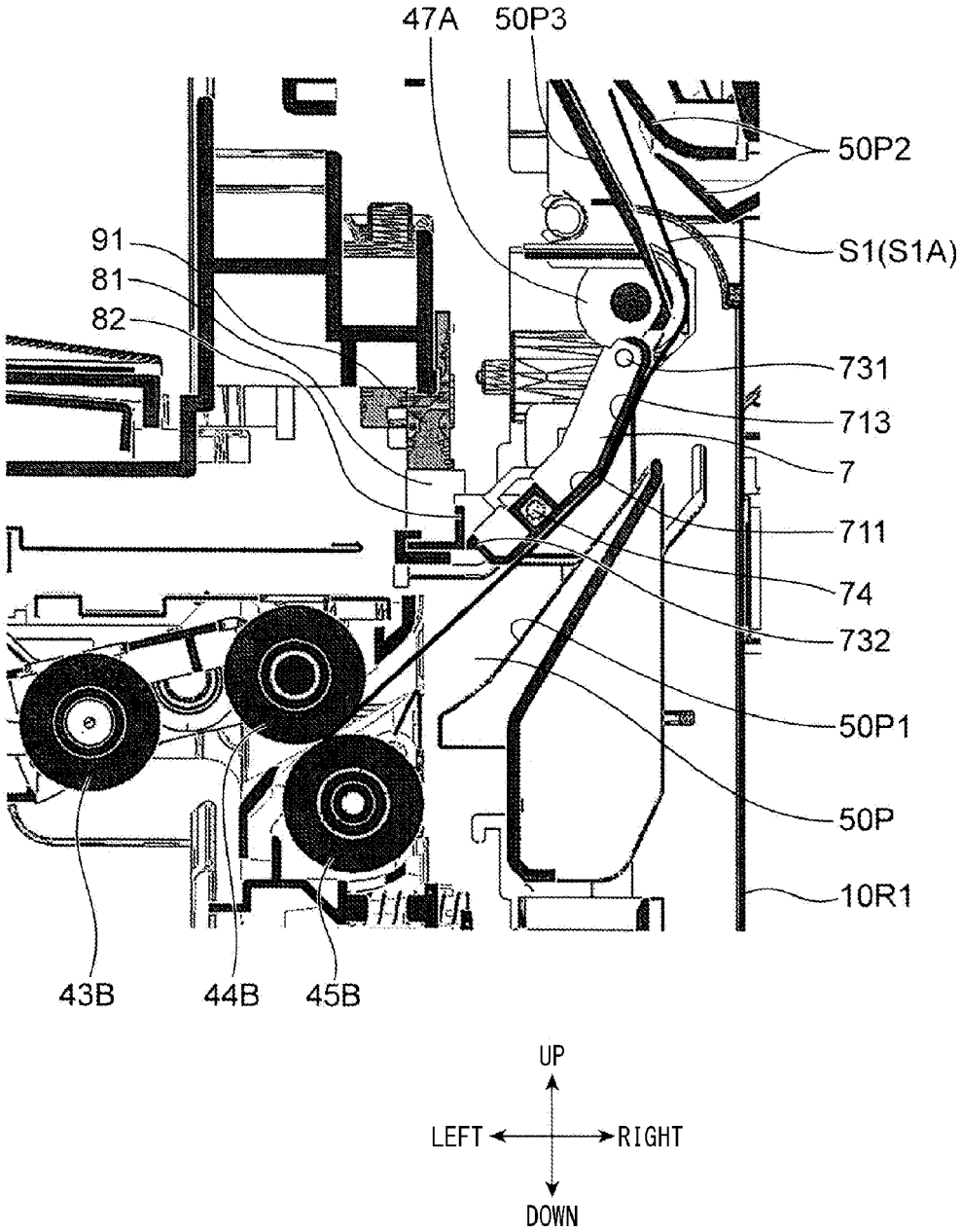
FIG. 8 is another sectional view schematically showing the sheet conveying path in another situation, in which the sheet guiding member advances, according to an embodiment of the present disclosure.
Figure 9:
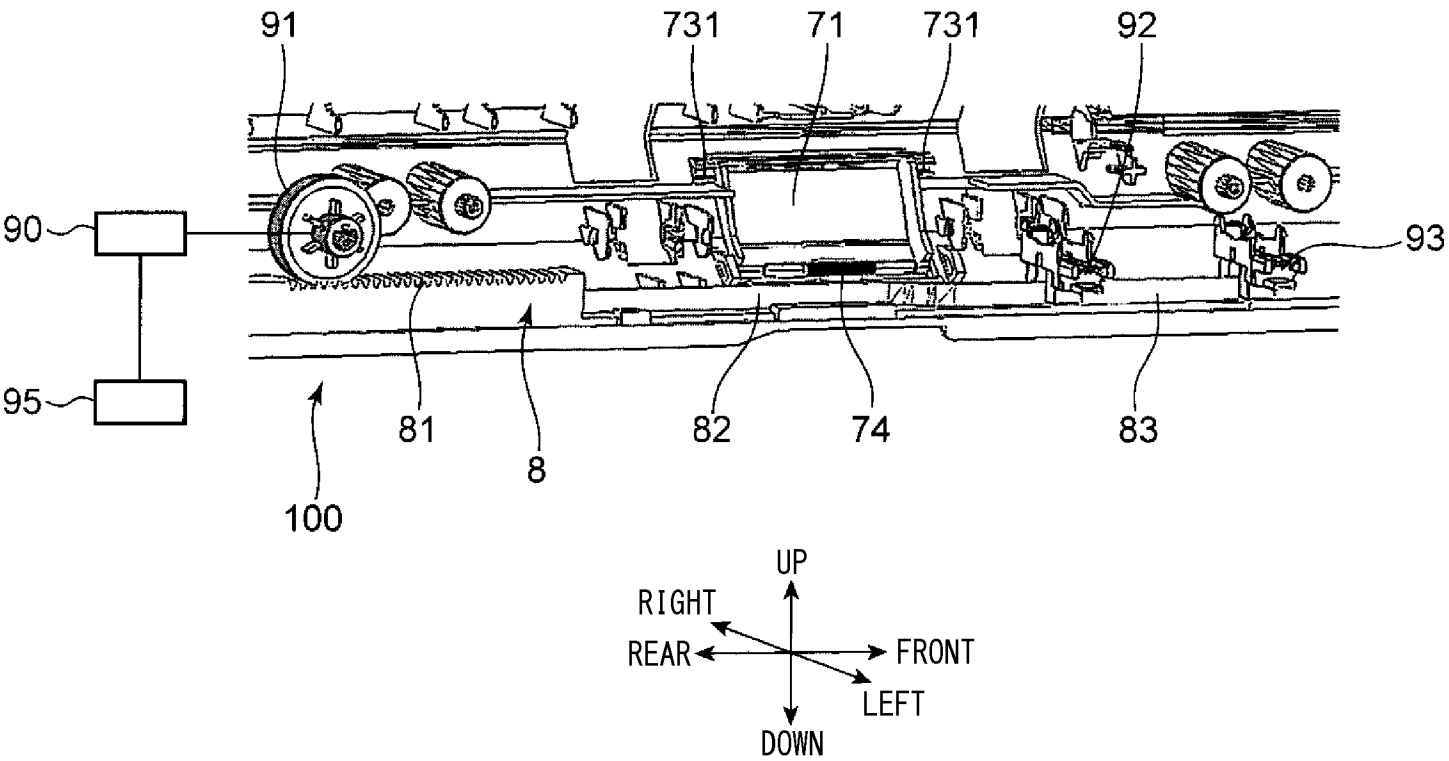
FIG. 9 is a perspective view schematically showing the switching part in the other situation shown in FIG. 8.
Figure 10:
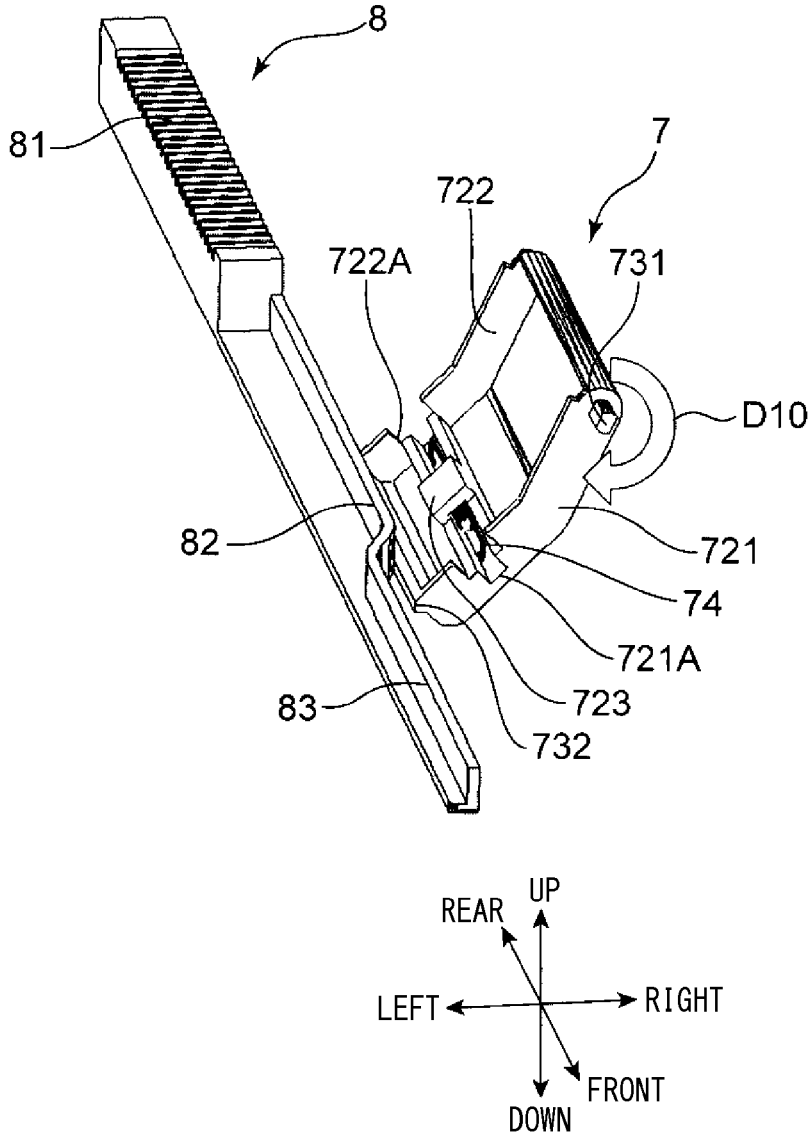
FIG. 10 is a perspective view schematically showing the contact member and sheet guiding member in the other situation shown in FIG. 8.
Figure 11:
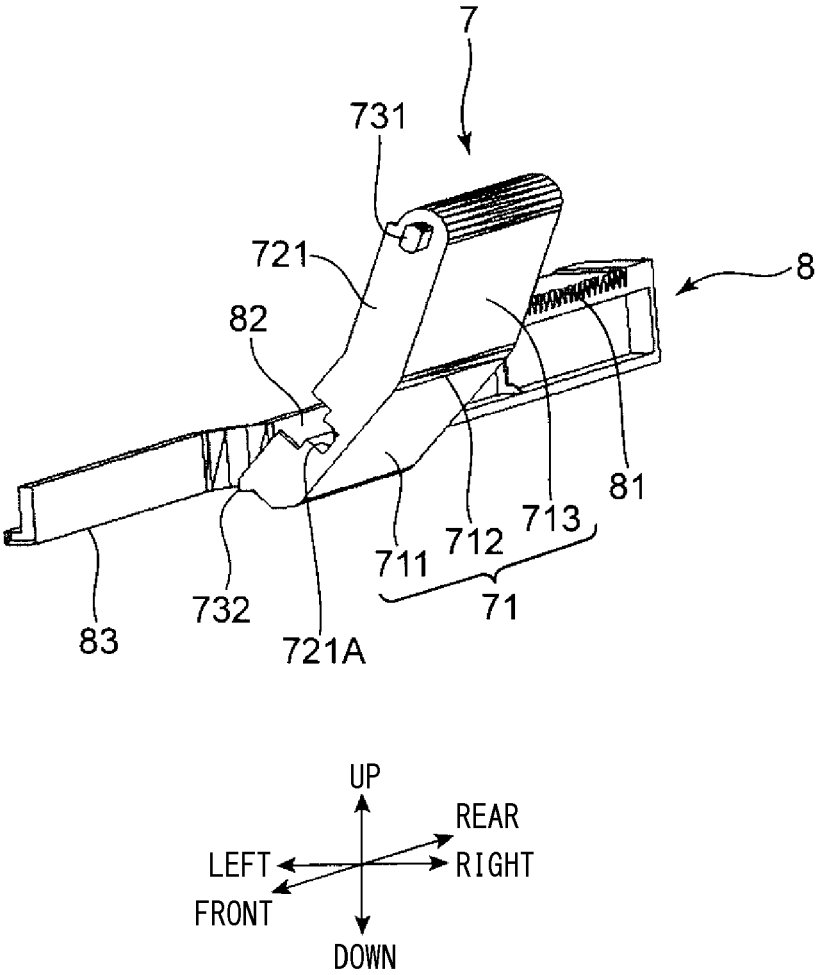
FIG. 11 is another perspective view schematically showing the contact member and sheet guiding member in the other situation shown in FIG. 8.

Next, with reference to FIGS. 5 to 11 in addition to FIGS. 2 to 4, a configuration of the movable conveyance guide 7 will be described in detail. FIG. 4 described above is a sectional view showing the fed sheet conveying path 50P in a situation of making the movable conveyance guide 7 retreated. FIG. 5 is a perspective view showing a switching part 100 switching an advance state and a retreat state of the movable conveyance guide 7 in the situation shown in FIG. 4. FIGS. 6 and 7 are perspective views showing a contact member 8 and the movable conveyance guide 7 in the situation shown in FIG. 4. On the other hand, FIG. 8 is a sectional view showing the fed sheet conveying path 50P in the embodiment in a situation of making the movable conveyance guide 7 advanced. FIG. 9 is a perspective view showing the switching part 100 in the situation shown in FIG. 8. FIGS. 10 and 11 are perspective views showing the contact member 8 and movable conveyance guide 7 in the situation shown in FIG. 8.

As referred to FIGS. 4, 6 and 7, the movable conveyance guide 7 is a board-liked member having a predetermined width in the forward and backward directions and extending from a left and lower side to a right and upper side. As shown in FIG. 2, the movable conveyance guide 7 is located in a center part of the fed sheet conveying path 50P in the sheet width direction. The movable conveyance guide 7 includes a pressing part 71, a front face part 721, a back face part 722, a holding part 723, rotation axes 731, a contacted part 732 and a biasing spring (a biasing member) 74.

The pressing part 71 is configured so as to advance to the fed sheet conveying path 50P and to come into contact with the sheet face of the sheet 51. The pressing part 71 includes a lower pressing part (a flat surface) 711, a connection part 712 and an upper pressing part (another flat surface) 713. The lower pressing part 711 and upper pressing part 713 are two flat surfaces having a predetermined width in the sheet width direction and being connected to each other in the sheet conveying direction so as to intersect at a predetermined angle. The connection part 712 is an intersection part of the lower pressing part 711 and upper pressing part 713, and is located so as to project toward the fed sheet conveying path 50P.

The front face part 721 and back face part 722 are a pair of side walls vertically arranged from edges in the forward and backward directions of the pressing part 71. In lower end parts of the front face part 721 and back face part 722, a front notch part 721A and a rear notch part 722A formed by notching parts of respective upper edges are arranged. As referred to FIG. 6, between the front notch part 721A and rear notch part 722A, in a reverse face of the pressing part 71, the biasing spring 74 mentioned below is located. The holding part 723 has a function of holding the biasing spring 74 between the front notch part 721A and rear notch part 722A. In other words, between the holding part 723 and pressing part 71, a penetration hole (not shown) for inserting the biasing spring 74 is formed.

The rotation axes 731 are a pair of rotation axes extending in the sheet width direction in upper end parts of the front face part 721 and back face part 722. The rotation axes 731 works as a rotation axis for rotating the movable conveyance guide 7 in the advance movement and retreat movement of the movable conveyance guide 7. In the embodiment, an upper end part of the movable conveyance guide 7 works as a fulcrum and a lower end part of the movable conveyance guide 7 is turnable.

The contacted part 732 is corresponding to a lower edge of the pressing part 71. When the lower end part of the movable conveyance guide 7 is turned, a first contact part 82 and a second contact part 83 of the contact member 8 mentioned below come into contact with the contacted part 732.

The biasing spring 74 is located between the front notch part 721A and rear notch part 722A in the reverse face of the pressing part 71. A center part in the sheet width direction of the biasing spring 74 is held by the holding part 723. One end part and another end part of the biasing spring 74 are located near the front notch part 721A and rear notch part 722A.

These end parts are fixed by a fixing part (not shown) located inside the apparatus main body 10. As referred to FIG. 6, the biasing spring 74 biases the movable conveyance guide 7 so that the pressing part 71 of the movable conveyance guide 7 retreat from the fed sheet conveying path 50P (indicated by an arrow D6 in FIG. 6).

Next, the switching part 100 will be described. The advance movement and retreat movement of the movable conveyance guide 7 is actualized by the switching part 100. The switching part 100 is located so as to come into contact with the movable conveyance guide 7. The switching part 100 turns the movable conveyance guide 7 around the rotation axes 731, thereby switching the advance movement and retreat movement of the movable conveyance guide 7. The switching part 100 includes the contact member 8, a motor 90 and a driving gear 91 (both being driving parts), a first sensor 92 and a second sensor 93. The switching operation of the switching part 100 is controlled by a control part 95 (FIG. 3) installed in the image forming apparatus 1.

The contact member 8 is configured so as to come into contact with the contacted part 732 of the pressing part 71. The contact member 8 is also configured so as to slidingly move in the sheet width direction. The contact member 8 includes a bottom face part 80, a gear part 81, the first contact part 82 and the second contact part 83. The bottom face part 80 constitutes a bottom part of the contact member 8, faces to upward and downward directions and extends in the forward and backward directions. The gear part 81 is connected to a rear end part of the bottom face part 80. An upper face part of the gear part 81 is formed in a gear shape having a plurality of gear teeth arranged adjacent to each other in the forward and backward directions. The first contact part 82 is a wall part vertically arranged from a right side edge of the bottom face part 80 at a side of the gear part 81. When the first contact part 82 comes into contact with the contacted part 732 of the movable conveyance guide 7, the movable conveyance guide 7 is moved against biasing force to become the advance state. The second contact part 83 is another wall part connecting to a front side of the first contact part 82. The second contact part 83 is located at a difference level shifted to a left side from the first contact part 82. In other words, as referred to FIG. 6, the second contact part 83 is hollowed to the left side from the first contact part 82 in a view of the contacted part 732 of the movable conveyance guide 7.

The motor 90 (FIG. 3) communicates rotation driving force to the driving gear 91. The motor 90 is driven and rotated by the control part 95. The motor 90 is configured so as to rotate in positive and negative directions. The driving gear 91 is a spur gear connected to the motor 90, and is engaged with the gear part 81 of the contact member 8. In FIG. 3, when the motor 90 is rotated in the positive and negative directions, the driving gear 91 is rotated in clockwise and counterclockwise directions. As a result, by driving force communicated to the gear part 81, the contact member 8 is slidingly moved in backward and forward directions.

The first sensor 92 and second sensor 93 are located at a distance in front of the contact member 8. The first sensor 92 and second sensor 93 detect a top end part (a front end part) of the second contact part 83 of the contact member 8. The first sensor 92 and second sensor 93 are light transmissive sensors. When the first sensor 92 and second sensor 93 detect the second contact part 83, the first sensor 92 and second sensor 93 output a HIGH signal to the control part 95. While the first sensor 92 and second sensor 93 do not detect the second contact part 83, the first sensor 92 and second sensor 93 output a LOW signal to the control part 95.

The control part 95 includes a CPU (Central Processing Unit), a ROM (Read Only Memory) storing control program, a RAM (Random Access Memory) used as a work area of the CPU and others. The control part 95 is electrically connected to the first sensor 92 and second sensor 93.

Next, the advance movement and retreat movement of the movable conveyance guide 7 will be described. After the sheet S1B having the basic weight of 55 g/m$^2$ or more is loaded in the second fed sheet cartridge 40B, the user inputs sheet information of the sheet S1B by means of an operation panel (not shown) of the image forming apparatus 1. Then, the control part 95 of the image forming apparatus 1 recognizes that the sheet S1B is loaded in the second fed sheet cartridge 40B. Alternatively, the fed sheet conveying path 50P may be provided with a sheet detecting part (not shown) to detect the thickness of the sheet, and then, the detected result may be transmitted to the control part 95. When the sheet S1B on the second fed sheet cartridge 40B is selected as the sheet S1 on which the image is formed in the image forming part 30, the control part 95 controls to carry out the advance movement of the movable conveyance guide 7.

The control part 95 inputs and decides the output signal of the first sensor 92 and second sensor 93. At this time, when both the first sensor 92 and second sensor 93 output LOW signals, the second contact part 83 of the contact member 8 is not facing to the first sensor 92 and second sensor 93. In other words, the contact member 8 has been slidingly moved backward (FIG. 5). In such a case, the movable conveyance guide 7 is biased by the biasing spring 74 in a direction indicated by the arrow D6 in FIG. 6 and the contacted part 732 of the movable conveyance guide 7 comes into contact with the second contact part 83 of the contact member 8 (FIGS. 6 and 7). Moreover, the lower pressing part 711 and upper pressing part 713 of the movable conveyance guide 7 become a state retreated from the fed sheet conveying path 50P as shown in FIG. 4.

By contrast, in carrying out the image forming process, when both the first sensor 92 and second sensor 93 output HIGH signals, the second contact part 83 of the contact member 8 is facing to the first sensor 92 and second sensor 93. In other words, the contact member 8 has been slidingly moved forward (FIG. 9). In such a case, in a situation where the biasing spring 74 biases the movable conveyance guide 7 in a direction indicated by an arrow D10 in FIG. 10, the first contact part 82 of the contact member 8 presses the contacted part 732 of the movable conveyance guide 7 against the biasing force in an opposite direction to the direction indicated by the arrow D10 (FIGS. 10 and 11). Moreover, the lower pressing part 711 and upper pressing part 713 of the movable conveyance guide 7 become another state advanced to the fed sheet conveying path 50P as shown in FIG. 8. At this time, the control part 95 controls to rotate the motor 90 in the positive direction and to rotate the driving gear 91 in the clockwise direction in FIG. 9. As a result, the contact member 8 is slidingly moved backward and the second contact part 83 is separated from the first sensor 92 and second sensor 93. Moreover, the contacted part 732 of the movable conveyance guide 7 comes into contact with the second contact part 83 of the contact member 8 (FIGS. 6 and 7). Accordingly, the movable conveyance guide 7 becomes the state retreated from the fed sheet conveying path 50P.

As referred to FIG. 4, in the state of the movable conveyance guide 7 retreated from the fed sheet conveying path 50P, the sheet S1B is guided between the sheet feeding roller 44B and first conveying roller 47A by the conveyance guide 50S (FIG. 2). In the conveyance guide 50S, a plurality of the rib members are placed at distances in the forward and backward directions. Therefore, the friction resistance of the sheet S1B to the conveyance guide 50S is decreased, thereby suitably conveying the sheet SIB. In addition, by the pair of the conveyance assisting rollers 94 located so as to interpose the movable conveyance guide 7 retreated from the fed sheet conveying path 50P in the forward and backward directions, the conveyance of the sheet S1B is promoted. With regard to the above mention, in other words, because the movable conveyance guide 7 is retreated from the fed sheet conveying path 50P, the pressing part 71 of the movable conveyance guide 7 does not come into contact with the sheet SIB. Therefore, it is possible to restrain the pressing part 71 being the flat surface from coming into contact with the firm sheet S1B to cause the conveyance noise and the slide resistance of the sheet S1B from increasing.

On the other hand, after the sheet S1A having the basic weight less than 55 g/m$^2$ is loaded in the second fed sheet cartridge 40B, the user inputs sheet information of the sheet S1A by means of the operation panel (not shown) of the image forming apparatus 1. Then, the control part 95 of the image forming apparatus 1 recognizes that the sheet S1A is loaded in the second fed sheet cartridge 40B. Alternatively, as mentioned above, the fed sheet conveying path 50P may be provided with a sheet detecting part (not shown) to detect the thickness of the sheet, and then, the detected result may be transmitted to the control part 95. In carrying out the image forming process, when the sheet S1A on the second fed sheet cartridge 40B is selected as the sheet S1 on which the image is formed in the image forming part 30, the control part 95 controls the movable conveyance guide 7 to become the advance state.

The control part 95 inputs and decides the output signal of the first sensor 92 and second sensor 93. At this time, when both the first sensor 92 and second sensor 93 output LOW signals, the second contact part 83 of the contact member 8 is not facing to the first sensor 92 and second sensor 93. In other words, the contact member 8 has been slidingly moved backward (FIG. 5). In such a case, the movable conveyance guide 7 is biased by the biasing spring 74 in the direction indicated by the arrow D6 in FIG. 6 and the contacted part 732 of the movable conveyance guide 7 comes into contact with the second contact part 83 of the contact member 8 (FIGS. 6 and 7). Moreover, the lower pressing part 711 and upper pressing part 713 of the movable conveyance guide 7 become the state retreated from the fed sheet conveying path 50P as shown in FIG. 4. At this time, the control part 95 controls to rotate the motor 90 in the negative direction and to rotate the driving gear 91 in the counterclockwise direction in FIG. 5. As a result, the contact member 8 is slidingly moved forward and the second contact part 83 is located to face to the first sensor 92 and second sensor 93 (FIG. 9). Moreover, the contacted part 732 of the movable conveyance guide 7 comes into contact with the first contact part 82 of the contact member 8 (FIGS. 10 and 11). Accordingly, the movable conveyance guide 7 becomes the state advanced to the fed sheet conveying path 50P.

By contrast, in carrying out the image forming process, when both the first sensor 92 and second sensor 93 output HIGH signals, the second contact part 83 of the contact member 8 is facing to the first sensor 92 and second sensor 93. In other words, the contact member 8 has been slidingly moved forward (FIG. 9). In such a case, the movable conveyance guide 7 is biased by the biasing spring 74 in the direction indicated by the arrow D10 in FIG. 10 and the contacted part 732 of the movable conveyance guide 7 comes into contact with the first contact part 82 of the contact member 8 (FIGS. 10 and 11). Moreover, as shown in FIG. 8, the lower pressing part 711 and upper pressing part 713 of the movable conveyance guide 7 become the state advanced to the fed sheet conveying path 50P.

As referred to FIG. 8, in the state of the movable conveyance guide 7 advanced to the fed sheet conveying path 50P, the sheet S1A is guided between the roller pair of the sheet feeding roller 44B and retard roller 45B and the conveying roller pair 47 by the movable conveyance guide 7. Then, the pressing part 71 (the lower pressing part 711 and upper pressing part 713) of by the movable conveyance guide 7 comes into contact with the sheet face of the sheet S1A to which the tensile strength is applied between the sheet feeding roller 44B and first conveying roller 47A. In addition, in the embodiment, the movable conveyance guide 7 also comes into contact with a center part in the sheet width direction of the sheet face of the sheet S1A. Therefore, both side parts in the sheet width direction of the sheet S1A is stretched outside. As a result, it is possible to suitably restrain the waviness from being formed on the sheet S1A. At this time, a friction coefficient between the movable conveyance guide 7 and sheet S1A is determined lower than another friction coefficient between the conveyance guide 50S and sheet S1A. Therefore, it is possible to maintain the slide resistance between the movable conveyance guide 7 and sheet S1A low in the advance state of the movable conveyance guide 7.

In accordance with the embodiment described above, the sheet S1 conveyed in the first direction by the sheet feeding roller 44B is further conveyed in the second direction by the first conveying roller 47A. The movable conveyance guide 7 is located between the sheet feeding roller 44B and first conveying roller 47A so as to advance and retreat to the fed sheet conveying path 50P. The movable conveyance guide 7 in the advance state comes into contact with the sheet face of the sheet S1 conveyed while being bridged across the roller pair of the sheet feeding roller 44B and retard roller 45B and the conveying roller pair 47. The movable conveyance guide 7 becomes the advance state to the fed sheet conveying path 50P when the thickness of the sheet S1 is thinner than the predetermined threshold. Therefore, if the relative thin sheet S1A is conveyed in a situation where the tensile strength is applied to the sheet S1A between the sheet feeding roller 44B and first conveying roller 47A, it is possible to make the movable conveyance guide 7 come into contact with the sheet face of the sheet S1. As a result, it is possible by the tensile strength to suitably restrain the waviness extending in the sheet conveying direction from being formed on the sheet S1A. Moreover, if the relative thick sheet S1B is conveyed between the sheet feeding roller 44B and first conveying roller 47A, the movable conveyance guide 7 retreats from the fed sheet conveying path 50P. Therefore, it is possible to restrain the movable conveyance guide 7 from pressing the sheet face of the sheet S1B, a conveyance load of the sheet S1B from increasing and the conveyance noise by sliding from occurring.

In addition, in accordance with the above-mentioned embodiment, the movable conveyance guide 7 comes into contact with the center part in the sheet width direction of the sheet face of the conveyed sheet S1A. Therefore, it is possible to further restrain the waviness from being formed on the center part of the sheet S1A.

Moreover, in accordance with the above-mentioned embodiment, the pair of the conveyance assisting rollers 94 is located so as to interpose the movable conveyance guide 7 in the sheet width direction, and to convey the sheet S1 to the first conveying roller 47A in the retreat state of the movable conveyance guide 7. Therefore, when the relative thick sheet S1B is conveyed, it is possible by the conveyance assisting rollers 94 to suitably promote the conveyance of the sheet S1B.

Further, in accordance with the above-mentioned embodiment, because the pressing part 71 of the movable conveyance guide 7 comes into contact with the sheet face of the sheet S1A, it is possible to furthermore restrain the waviness from being formed on the sheet S1A.

Furthermore, in accordance with the above-mentioned embodiment, the movable conveyance guide 7 includes a plurality of the flat surfaces (the lower pressing part 711 and upper pressing part 713) having the predetermined width in the sheet width direction and being connected to each other in the sheet conveying direction so as to intersect at the predetermined angle. In addition, the connection part 712 between the plurality of the flat surfaces is located so as to project toward the fed sheet conveying path 50P. Therefore, it is possible by the plurality of the flat surfaces to restrain the waviness from being formed on the sheet S1A. Moreover, the connection part 712 between the plurality of the flat surfaces suitably applies the tensile strength to the sheet S1A, thereby further restraining the waviness.

In addition, in accordance with the above-mentioned embodiment, the movable conveyance guide 7 is biased by the biasing spring 74 so as to retreat from the fed sheet conveying path 50P. Moreover, the movable conveyance guide 7 is rotated around the rotation axis by the switching part 100, thereby advancing and retreating to the fed sheet conveying path 50P. The switching operation of the movable conveyance guide 7 is actualized by the contact member 8, motor 90 and driving gear 91. Particularly, by slide movement in the sheet width direction of the contact member 8, the movable conveyance guide 7 can advance. Therefore, it is possible to suitably reduce a space around the fed sheet conveying path 50P occupied by the contact member 8.

Although the above description explained the sheet feeding device 4 and image forming apparatus 1 including this according to the embodiment of the present disclosure, the present disclosure is not restricted to this embodiment. For example, the present disclosure may apply another following varied embodiment.

Although, in the above-described embodiment, a configuration of loading the sheet S1A or the sheet S1B in the second fed sheet cartridge 40B was explained, the present disclosure is not restricted to this configuration. In another embodiment, another configuration of loading the sheet S1A in the first fed sheet cartridge 40A and loading the sheet S1B in the second fed sheet cartridge 40B may be applied. In this other configuration, another similar movable conveyance guide 7 is located so as to advance and retreat to a sheet conveying path at a downstream side in the conveying direction from the first fed sheet cartridge 40A. When the sheet S1A is fed from the first fed sheet cartridge 40A, this other movable conveyance guide 7 advances to the sheet conveying path.

In addition, in the above-described embodiment, configurations of locating the rotation axes 731 of the movable conveyance guide 7 at a downstream side (one end side) of the first direction of the movable conveyance guide 7 and making the contact member 8 of the switching part 100 come into contact with an edge at an upstream side (another end side) of the first direction of the movable conveyance guide 7 were explained. However, the present disclosure is not restricted to these configurations. In another embodiment, other configurations of locating the rotation axes 731 of the movable conveyance guide 7 at the upstream side of the first direction of the movable conveyance guide 7 and making the contact member 8 of the switching part 100 come into contact with an edge at the downstream side of the first direction of the movable conveyance guide 7 may be applied.

Although, in the above-described embodiment, a configuration of actualizing the advance movement and retreat movement of the movable conveyance guide 7 by the slide movement of the contact member 8 of the switching part 100 was explained, the present disclosure is not restricted to this configuration. In another embodiment, another configuration of switching the advance movement and retreat movement of the movable conveyance guide 7 by making the contact member 8 moved in a direction crossing the sheet width direction may be applied.

Although, in the above-described embodiment, a configuration of switching the advance movement and retreat movement of the movable conveyance guide 7 according to the thickness of the sheet was explained, the present disclosure is not restricted to this configuration. In another embodiment, another configuration of switching the advance movement and retreat movement of the movable conveyance guide 7 according to sheet type, such as stiffness (rigidity) or material property of the sheet, may be applied.

Although, in the above-described embodiment, a configuration of the image forming part 30 using an electrographic image forming manner was explained, the present disclosure is not restricted to this configuration. In another embodiment, another configuration of another image forming part 30 using another image forming manner, such as an inkjet image forming manner, may be applied.

While the present disclosure has been described with reference to the preferable embodiment of the image forming apparatus of the disclosure and the description has technical preferable illustration, the disclosure is not to be restricted by the embodiment and illustration. Components in the embodiment of the present disclosure may be suitably changed or modified, or variously combined with other components. The claims are not restricted by the description of the embodiment.

What is claimed is:

1. A sheet conveying device comprising:

a housing;

a sheet conveying path arranged in the housing to convey a sheet in a first direction, and then, to convey the sheet in a second direction crossing the first direction;

a first conveying roller pair conveying the sheet in the first direction;

a second conveying roller pair located at a downstream side in a sheet conveying direction from the first conveying roller pair to convey the sheet to the second direction from the first direction; and a sheet guiding member located between the first conveying roller pair and second conveying roller pair and configured so as to have a rotation axis extending in a sheet width direction crossing the sheet conveying direction and to advance and retreat to the sheet conveying path by turning around the rotation axis, and then, in an advance state, to come into contact with a sheet face of the sheet conveyed while being bridged across the first conveying roller pair and second conveying roller pair; and a switching part making the sheet guiding member rotated around the rotation axis to switch the advance state and a retreat state of the sheet guiding member.

2. The sheet conveying device according to claim 1, further comprising a control part controlling the switching operation of the switching part, wherein the control part makes the sheet guiding member advanced to the sheet conveying path when thickness of the sheet conveyed in the sheet conveying path is thinner than a predetermined threshold, and makes the sheet guiding member retreated from the sheet conveying path when the thickness of the sheet is thicker than the threshold.

3. The sheet conveying device according to claim 1, wherein the sheet guiding member is located at a center part of the sheet conveying path in the sheet width direction.

4. The sheet conveying device according to claim 3 further comprising:

a pair of conveyance assisting rollers located so as to interpose the sheet guiding member in the sheet width direction, and then, in a retreat state of the sheet guiding member, to assist conveyance of the sheet to the second conveying roller pair.

5. The sheet conveying device according to claim 3 further comprising:

a guide member located so as to interpose the sheet guiding member in the sheet width direction, and then, to guide the sheet to the first direction, wherein a friction coefficient between the sheet guiding member and the sheet is lower than a friction coefficient between the guiding member and sheet.

6. The sheet conveying device according to claim 3, wherein the sheet guiding member comes into contact with a face of the sheet.

7. The sheet conveying device according to claim 6, wherein the sheet guiding member includes a plurality of flat surfaces having a predetermined width in the sheet width direction and being connected to each other in the sheet conveying direction so as to intersect at a predetermined angle, and a connection part between the plurality of the flat surfaces is located so as to project toward the sheet conveying path.

8. The sheet conveying device according to claim 7 further comprising a switching part, wherein the sheet guiding member includes:

a board-liked member having the plurality of the flat surfaces; and a biasing member biasing the board-liked member so that the plurality of the flat surfaces retreat from the sheet conveying path, and the rotation axis is extended in the sheet width direction from the board-liked member, the switching part is located in the housing so as to come into contact with the sheet guiding member.

9. The sheet conveying device according to claim 8, wherein the rotation axis is located at one end side in the first direction of the sheet guiding member, the switching part includes:

a contact member having a first contact part and a second contact part and enabling to slidingly move in the sheet width direction, wherein the first contact part making the sheet guiding member become the advance state against biasing force of the biasing member by coming into contact with a contacted part on another end side in the first direction of the sheet guiding member, and the second contact part being connected to the first contact part in the sheet width direction and making the sheet guiding member become the retreat state by coming into contact with the contacted part; and a driving part making the contact member slidingly moved.

10. The sheet conveying device according to claim 1 further comprising a sheet loading part loading the sheet, wherein the first conveying roller pair is composed of a a sheet feeding roller and a retard roller conveying a top of the sheet loaded on the sheet loading part in the first direction.

11. An image forming apparatus comprising:

a sheet conveying device; and an image forming part, wherein the sheet conveying device includes:

a housing;

a sheet conveying path arranged in the housing to convey a sheet in a first direction, and then, to convey the sheet in a second direction crossing the first direction;

a first conveying roller pair conveying the sheet in the first direction;

a second conveying roller pair located at a downstream side in a sheet conveying direction from the first conveying roller pair to convey the sheet to the second direction from the first direction; and a sheet guiding member located between the first conveying roller pair and second conveying roller pair and configured so as to have a rotation axis extending in a sheet width direction crossing the sheet conveying direction and to advance and retreat to the sheet conveying path by turning around the rotation axis, and then, in an advance state, to come into contact with a sheet face of the sheet conveyed while being bridged across the first conveying roller pair and second conveying roller pair; and a switching part making the sheet guiding member rotated around the rotation axis to switch the advance state and a retreat state of the sheet guiding member, and the image forming part forms an image on the sheet conveyed in the second direction.

12. The image forming apparatus according to claim 11, further comprising a control part controlling the switching operation of the switching part, wherein the control part makes the sheet guiding member advanced to the sheet conveying path when thickness of the sheet conveyed in the sheet conveying path is thinner than a predetermined threshold, and makes the sheet guiding member retreated from the sheet conveying path when the thickness of the sheet is thicker than the threshold.

13. The image forming apparatus according to claim 11, wherein the sheet guiding member is located at a center part of the sheet conveying path in the sheet width direction.

14. The image forming apparatus according to claim 13 further comprising:

a pair of conveyance assisting rollers located so as to interpose the sheet guiding member in the sheet width direction, and then, in a retreat state of the sheet guiding member, to assist conveyance of the sheet to the second conveying roller pair.

15. The image forming apparatus according to claim 13 further comprising:

a guide member located so as to interpose the sheet guiding member in the sheet width direction, and then, to guide the sheet to the first direction, wherein a friction coefficient between the sheet guiding member and the sheet is lower than a friction coefficient between the guiding member and sheet.

16. The image forming apparatus according to claim 13, wherein the sheet guiding member comes into contact with a face of the sheet.

17. The image forming apparatus according to claim 16, wherein the sheet guiding member includes a plurality of flat surfaces having a predetermined width in the sheet width direction and being connected to each other in the sheet conveying direction so as to intersect at a predetermined angle, and a connection part between the plurality of the flat surfaces is located so as to project toward the sheet conveying path.

18. The image forming apparatus according to claim 17 further comprising a switching part, wherein the sheet guiding member includes:

a board-liked member having the plurality of the flat surfaces; and a biasing member biasing the board-liked member so that the plurality of the flat surfaces retreat from the sheet conveying path, and the rotation axis is extended in the sheet width direction from the board-liked member, the switching part is located in the housing so as to come into contact with the sheet guiding member.

19. The image forming apparatus according to claim 18, wherein the rotation axis is located at one end side in the first direction of the sheet guiding member, the switching part includes:

a contact member having a first contact part and a second contact part and enabling to slidingly move in the sheet width direction, wherein the first contact part making the sheet guiding member become the advance state against biasing force of the biasing member by coming into contact with a contacted part on another end side in the first direction of the sheet guiding member, and the second contact part being connected to the first contact part in the sheet width direction and making the sheet guiding member become the retreat state by coming into contact with the contacted part; and a driving part making the contact member slidingly moved.

20. The image forming apparatus according to claim 11 further comprising a sheet loading part loading the sheet, wherein the first conveying roller pair is composed of a sheet feeding roller and a retard roller conveying a top of the sheet loaded on the sheet loading part in the first direction.

* * * * *